US008957814B2

(12) United States Patent
Eom et al.

(10) Patent No.: US 8,957,814 B2
(45) Date of Patent: Feb. 17, 2015

(54) ANTENNA DEVICE FOR A PORTABLE TERMINAL

(75) Inventors: Sang-Jin Eom, Gyeonggi-do (KR); Hoon Park, Seoul (KR); Ho-Saeng Kim, Gyeonggi-do (KR); Austin Kim, Gyeonggi-do (KR); Yong-Jin Kim, Seoul (KR); Chi-Hyung Ahn, Gyeonggi-do (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 230 days.

(21) Appl. No.: 13/435,269

(22) Filed: Mar. 30, 2012

(65) Prior Publication Data

US 2012/0313834 A1 Dec. 13, 2012

(30) Foreign Application Priority Data

Jun. 10, 2011 (KR) ..... 10-2011-0056410

(51) Int. Cl.

| | |
|---|---|
| ***H01Q 1/24*** | (2006.01) |
| ***H01Q 5/00*** | (2006.01) |
| ***H01Q 9/42*** | (2006.01) |
| ***H01Q 13/16*** | (2006.01) |

(52) U.S. Cl.

CPC ..... *H01Q 1/243* (2013.01); *H01Q 5/0017* (2013.01); *H01Q 5/0062* (2013.01); *H01Q 5/0072* (2013.01); *H01Q 9/42* (2013.01); *H01Q 13/16* (2013.01)

USPC ..... 343/702; 343/767

(58) Field of Classification Search

CPC ..... H01Q 1/243; H01Q 5/0062; H01Q 9/42

USPC ..... 343/702, 767

See application file for complete search history.

(56) References Cited

U.S. PATENT DOCUMENTS

| | | | | |
|---|---|---|---|---|
| 5,914,693 | A * | 6/1999 | Takei et al. | 343/767 |
| 6,263,193 | B1 * | 7/2001 | Iseki et al. | 455/84 |
| 7,301,499 | B2 * | 11/2007 | Shin et al. | 343/700 MS |
| 7,551,142 | B1 * | 6/2009 | Zhang et al. | 343/702 |
| 7,872,605 | B2 * | 1/2011 | Baliarda et al. | 343/700 MS |
| 8,077,096 | B2 * | 12/2011 | Chiang et al. | 343/702 |
| 2009/0256757 | A1 * | 10/2009 | Chiang et al. | 343/702 |
| 2010/0123632 | A1 | 5/2010 | Hill et al. | |

* cited by examiner

*Primary Examiner* — Hoang V Nguyen
(74) *Attorney, Agent, or Firm* — Cha & Reiter, LLC

(57) ABSTRACT

An antenna device attains good antenna performance using at least one or more metal members installed in a portable terminal. The antenna device includes a main board equipped with a power supply part for supplying power, a slot part which is positioned in at least one or more metal members or is formed by a combination of the metal members, and a power supply antenna member for receiving power from the power supply part and which is electromagnetically coupled with the slot part.

19 Claims, 13 Drawing Sheets

ANTENNA DEVICE FOR A PORTABLE TERMINAL

CLAIM OF PRIORITY

This application claims, pursuant to 35 U.S.C. §119(a), priority to and the benefit of a Korean patent application filed in the Korean Intellectual Property Office on Jun. 10, 2011 and assigned Serial No. 10-2011-0056410, the entire disclosure of which is hereby incorporated by reference.

BACKGROUND OF THE INVENTION

1. Field of the Invention

The present invention relates to an antenna device for a portable terminal More particularly, the present invention relates to an antenna device for improving antenna performance using at least one or more metal members installed in a portable terminal 2. Description of the Related Art Portable terminals such as mobile communication terminals (cellular phones), electronic schedulers, Personal Digital Assistants (PDAs), and personal complex terminals have become necessities of current society due to the rapid development of electronic communication industries. Portable terminals have developed into an important means of information transmission, which are quickly changing the manner in which information is used and managed.

In this situation, functions have been gradually added to portable terminals, and portable terminals are characterized by their lightness, thinness, compactness, and smallness. Accordingly, it is becoming more and more difficult to mount a plurality of components in the limited space of a portable terminal when portable terminals are becoming light, thin, compact, and small. As is well known in the art, a portable terminal has an antenna for establishing communication services such as a telephone conversation service and an Internet service. In general, the larger the antenna, the better performance the portable terminal has. However, it is becoming more and more difficult to implement an antenna with a desired performance in a limited space. In addition, use of a metal member for mounting or implementing the components of a miniaturized terminal or for beautifying the appearance of the portable terminal is increasing. However, such use of a metal member results in degradation of antenna performance.

SUMMARY OF THE INVENTION

An aspect of the present invention is to solve at least the above-mentioned problems and/or disadvantages and to provide at least the advantages described below. Accordingly, an aspect of the present invention is to provide an antenna device capable of miniaturizing a portable terminal and attaining improved antenna performance.

Another aspect of the present invention is to provide an antenna device capable of attaining improved antenna performance using at least one or more metal members installed for other purposes in a portable terminal.

Another aspect of the present invention is to provide an antenna device for radiating radio waves using a slot part which is formed in at least one or more metal members formed in a portable terminal or is formed by combination of the metal members.

In accordance with an aspect of the present invention, an antenna device for a portable terminal is provided. The antenna device comprises a main board equipped with a power supply part for supplying power, a slot part which is positioned in at least one or more metal members or is formed by a combination of the metal members, and a power supply antenna member for receiving power from the power supply part and which is electromagnetically coupled with the slot part.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION OF THE INVENTION

Hereinafter, preferred embodiments of the present invention will be described herein below with reference to the accompanying drawings. This invention may, however, be embodied in many different forms and should not be construed as limited to the exemplary embodiments set forth herein. In the following description, well-known functions or constructions are not described in detail since they would obscure the invention in unnecessary detail. Also, the terms used herein are defined according to the functions of the present invention. Thus, the terms may vary depending on user's or operator's intension and usage. That is, the terms used herein must be understood based on the descriptions made herein. The principles and features of this invention may be employed in varied and numerous embodiments without departing from the scope of the invention.

Among the terms set forth herein, a terminal refers to any kind of device capable of processing data which is transmitted or received to or from any external entity. The terminal may display icons or menus on a screen to which stored data and various executable functions are assigned or mapped. The terminal may include a computer, a notebook, a tablet PC, a mobile device, and the like.

The present invention described hereinafter relates to an antenna device capable of attaining improved antenna performance using at least one or more metal members installed for other purposes in a portable terminal. The present invention allows a metal member installed in a portable terminal to not degrade antenna performance, but instead to enhance antenna performance. An antenna device according to the exemplary embodiments of the present invention described herein may radiate radio waves using a slot part which is formed in at least one or more metal members installed in a portable terminal or is formed by combination of the metal members.

Figure 1:
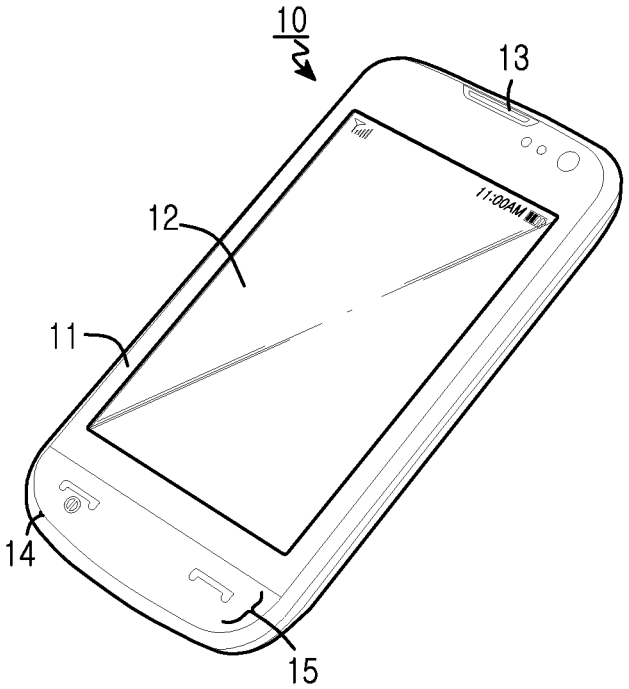
FIG. 1 is a perspective view of a portable terminal according to the exemplary embodiments of the present invention.

FIG. 1 is a perspective view of a portable terminal according to the exemplary embodiments of the present invention.

Referring to FIG. 1, the portable terminal denoted generally by 10 includes a case frame 11 for forming the external appearance of the portable terminal 10, and components, described later, installed in the case frame 11. The portable terminal 10 includes at least one of a display 12, a speaker 13, a microphone 14, and/or a key button 15, as well as other components which are well known.

According to the exemplary embodiments of the present invention, described herein in connection with FIGS. 2-13B, the portable terminal 10 of FIG. 1 includes a built-in antenna device for communications and having the following exemplary configurations. The antenna device according to one exemplary embodiment of the present invention directly or indirectly supplies power to a slot part formed in at least one or more metal members installed in the portable terminal 10 or is formed by combination of the metal members and allows the slot part to radiate radio waves. The metal member may be a metal plate for reinforcing or mounting a Printed Circuit Board (PCB), a display unit forming the display 12, etc., a metal structure for supporting a battery, a metallic case frame for beautifying, or otherwise making more aesthetically pleasing, the appearance of the portable terminal 10, etc.

The antenna device according to one exemplary embodiment of the present invention is electromagnetically coupled with the slot part, that is, the antenna device indirectly supplies power to the slot part. The antenna device includes a main board equipped with a power supply part for supplying power, and an power supply antenna member which is positioned in or out of the slot part and is electrically connected with the power supply part of the main board. The power supply antenna member receives power from the power supply part and radiates radio waves. The slot part is electromagnetically coupled by the radiation of the power supply antenna member and radiates radio waves. The slot part may have the shape of a circle, a polygon, an elbow or L-shape, or other shapes, such as the various substantially L-shaped or polyominal-shaped slots, such as pentominal shapes or the like, shown in FIGS. 2-11. In particular, the slot part may be filled with a dielectric or a magnetic substance to improve radiation performance. The power supply antenna member may operate as a monopole-type antenna, a loop-type antenna, etc.

Figure 2:
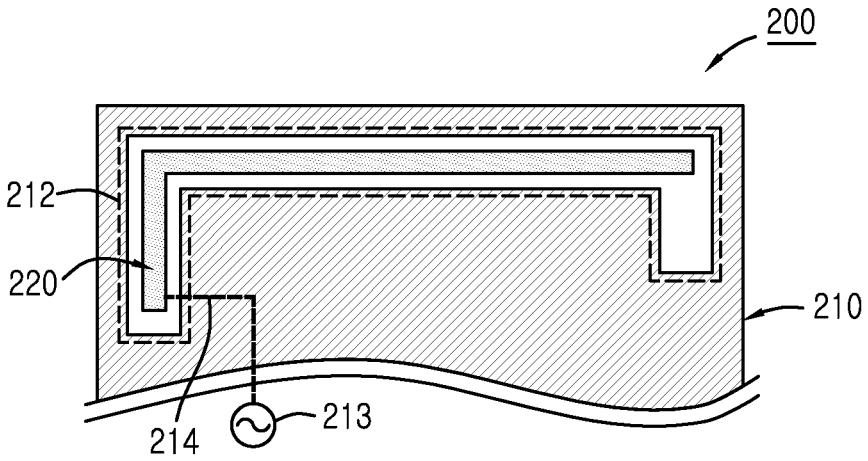
FIG. 2 illustrates a structure of an antenna device according to a first exemplary embodiment of the present invention.

FIG. 2 illustrates a structure of an antenna device according to a first exemplary embodiment of the present invention.

Referring to FIG. 2, the antenna device denoted by 200, according to the first exemplary embodiment of the present invention, includes a slot antenna member 210 equipped with a slot part 212, a power supply antenna member 220 which is positioned in the slot part 212, and a power supply part 213 for supplying power to the power supply antenna member 220. The power supply antenna member 220 receives power from the power supply part 213 and radiates radio waves. The slot part 212 of the slot antenna member 210 is electromagnetically coupled with the power supply antenna member 220 and radiates radio waves. As shown in FIG. 2, the slot part 212 may have a thin and long groove shape. The power supply antenna member 220 may have a shape allowing the power supply antenna member 220 to be positioned along and within a groove of the slot part 212. The amount of the electromagnetic coupling may be determined according to a shape or a size of the power supply antenna member 220, a distance by which the power supply antenna member 220 is spaced apart from the slot part 212, etc. An antenna matching may then be determined according to the determined quantity of the amount of the electromagnetic coupling of the slot part 212 and the power supply antenna member 220.

The slot antenna member 210 may be a singular and/or monolithic metal member, or may be an assembly of a variety of metal members which are combined. Accordingly, the slot part 212 may also be formed from a singular and/or monolithic metal member, or may be formed by combination of the variety of metal members. The slot antenna member 210 may be a metal plate for mounting a PCB, a display unit, etc., a metal structure for supporting a battery, a metallic case frame for beautifying the appearance of a portable terminal, etc. For example, the slot part 212 may be formed by the combination of a ground surface of a PCB and a plate for supporting and mounting a display unit electrically connected with the PCB, etc.

The power supply part 213 is installed on a main board or on a PCB of the portable terminal, and the power supply part 213 is electrically connected with the power supply antenna member 220 through a connector 214. The main board is a board which mounts basic circuits and components. The main board provides an execution or operating environment of the portable terminal and maintains the operating conditions of the portable terminal. The main board allows the portable terminal to be safely driven and operated, and smoothly performs data input and output of at least one device, which may include all devices and components of the portable terminal.

The slot antenna member 210 may be included on or incorporated into the main board. In general, the main board is equipped with a ground surface or structure for reducing harmful electrical elements and effects, such as noise. The slot part 212 may be installed on the ground surface. In an example embodiment, the power supply antenna member 220 may have a loop-type antenna structure. That is, the power supply antenna member 220 may be operated as a loop antenna with one end being electrically connected with the power supply part 213 and the other end being electrically connected with the ground surface.

Figure 3:
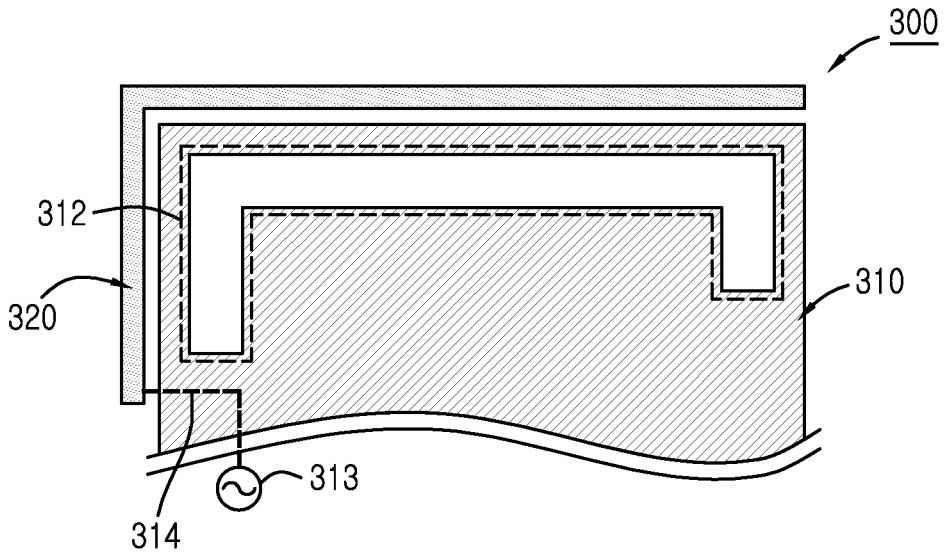
FIG. 3 illustrates a structure of an antenna device according to a second exemplary embodiment of the present invention.

FIG. 3 illustrates a structure of an antenna device according to a second exemplary embodiment of the present invention.

Referring to FIG. 3, the antenna device denoted by 300, according to the second exemplary embodiment of the present invention, includes a slot antenna member 310 equipped with a slot part 312, a power supply antenna member 320 which is positioned externally relative to the slot part 312, and a power supply part 313 for supplying power to the power supply antenna member 320. The power supply antenna member 320 receives power from the power supply part 313 and radiates radio waves. The slot part 312 of the slot antenna member 310 is electromagnetically coupled with the power supply antenna member 320 and radiates radio waves.

In particular, the power supply antenna member 320 is spaced apart from the slot antenna member 310 and has a shape and is positioned such that the power supply antenna member 320 extends substantially parallel to a groove of the slot part 312. Accordingly, referring to FIG. 3, a first portion of the power supply antenna member 320 extends vertically and parallel to a corresponding first portion of the slot antenna member 310, and a second portion of the power supply antenna member 320 extends horizontally and parallel to a corresponding second portion of the slot member 310.

Because the slot part 312 and associated contents and components have common features to the slot part 212 described above in FIG. 2, reference is made herein to the description above regarding the slot part 212 to describe the features and operating characteristics of the slot part 312, for example, in the electromagnetic coupling of the slot part 312 and its associated power supply antenna member 320.

Figure 4:
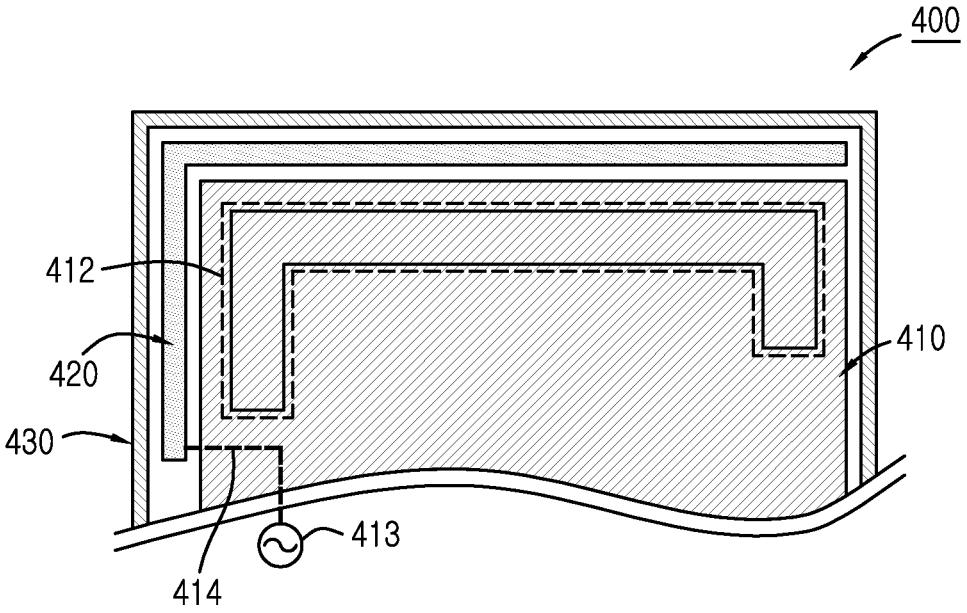
FIG. 4 illustrates a structure of an antenna device according to a third exemplary embodiment of the present invention.

FIG. 4 illustrates a structure of an antenna device according to a third exemplary embodiment of the present invention.

Referring to FIG. 4, the antenna device denoted by 400, according to the third exemplary embodiment of the present invention, includes a slot antenna member 410 equipped with a slot part 412, a power supply antenna member 420 which is positioned externally relative to the slot part 412, and a power supply part 413 for supplying power to the power supply antenna member 420. The power supply antenna member 420 receives power from the power supply part 413 and radiates radio waves. The slot part 412 of the slot antenna member 410 is electromagnetically coupled with the power supply antenna member 420 and radiates radio waves.

In particular, the antenna device 400 may further include a metallic external member 430 which surrounds both the slot antenna member 410 and the power supply antenna member 420, and electrically insulates the members 410, 420 from each other. The power supply antenna member 420 is interposed between the slot antenna member 410 and the metallic external member 430, and the power supply antenna member 420 has a shape and is positioned along a groove of the slot part 412, such that the power supply antenna member 420 extends substantially parallel to a groove of the slot part 412. Accordingly, referring to FIG. 4, a first portion of the power supply antenna member 420 extends vertically and parallel to a corresponding first portion of the slot antenna member 410, and a second portion of the power supply antenna member 420 extends horizontally and parallel to a corresponding second portion of the slot member 410.

Because the slot part 412 and associated contents and components have common features to the slot part 212 described above in FIG. 2, reference is made herein to the description above regarding the slot part 212 to describe the features and operating characteristics of the slot part 412, for example, in the electromagnetic coupling of the slot part 412 and its associated power supply antenna member 420.

In addition, the slot part 412 may optionally be filled with a dielectric or a magnetic substance known in the art for providing improved antenna performance. Other slots in the other exemplary embodiments described herein may also be optionally filled with a dielectric or a magnetic substance known in the art. $BaTiO_3$ ceramic material or $NiNbO_4$ material may be used as dielectric material.

Figure 5:
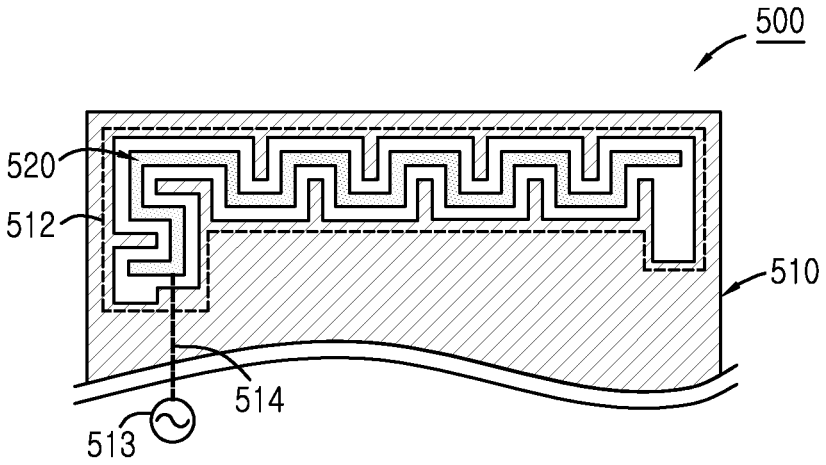
FIG. 5 illustrates a structure of an antenna device according to a fourth embodiment of the present invention.

FIG. 5 illustrates a structure of an antenna device according to a fourth exemplary embodiment of the present invention.

Referring to FIG. 5, the antenna device denoted by 500, according to the fourth exemplary embodiment of the present invention, is constructed in a similar manner to the antenna device 200 in FIG. 2. The antenna device 500 includes a slot antenna member 510, a power supply antenna member 520, and a power supply part 513. As shown in FIG. 5, a slot part 512 of the slot antenna member 510 may have a zigzag shape or another convoluted shape for effectively increasing the surface area of the slot for improved antenna performance. The power supply member 520 may have a shape such that the power supply member 520 is positioned to extend along and within a groove of the slot part 512.

Because the slot part 512 and associated contents and components have common features to the slot part 212 described above in FIG. 2, reference is made herein to the description above regarding the slot part 212 to describe the features and operating characteristics of the slot part 512, for example, in the electromagnetic coupling of the slot part 512 and its associated power supply antenna member 520.

Figure 6:
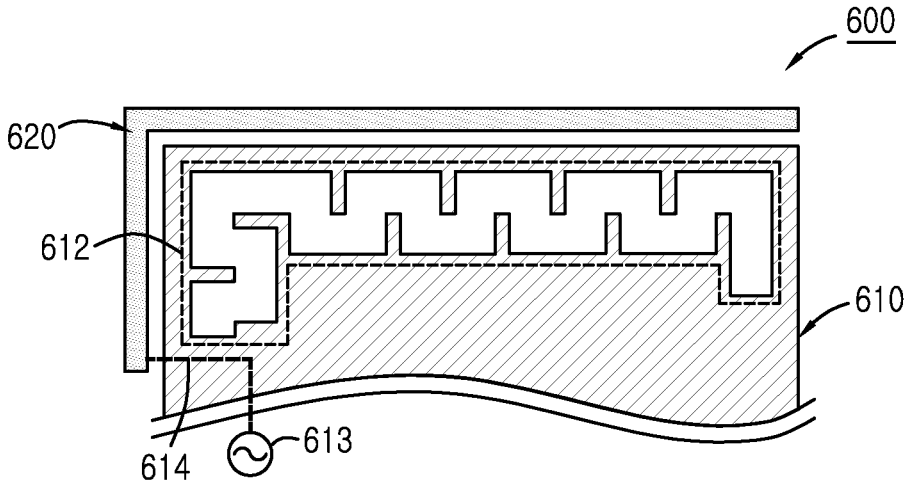
FIG. 6 illustrates a structure of an antenna device according to a fifth embodiment of the present invention.

FIG. 6 illustrates a structure of an antenna device according to a fifth exemplary embodiment of the present invention.

Referring to FIG. 6, the antenna device denoted by 600, according to the fifth exemplary embodiment of the present invention, is constructed in a similar manner as the second exemplary embodiment shown in FIG. 3 and described herein. In the fifth exemplary embodiment, the antenna device 600 includes a slot antenna member 610, a power supply antenna member 620, and a power supply part 613. As shown in FIG. 6, a slot part 612 of the slot antenna member 610 may have a zigzag shape or another convoluted shape. The power supply antenna member 620 is spaced apart from the slot antenna member 610 and may have a shape and is positioned to substantially surround a groove of the slot part 612, such that the power supply antenna member 620 extends substantially parallel to a groove of the slot part 612. Accordingly, referring to FIG. 6, a first portion of the power supply antenna member 620 extends vertically and parallel to a corresponding first portion of the slot antenna member 610, and a second portion of the power supply antenna member 620 extends horizontally and parallel to a corresponding second portion of the slot member 610.

Because the slot part 612 and associated contents and components have common features to the slot part 212 described above in FIG. 2, reference is made herein to the description above regarding the slot part 212 to describe the features and operating characteristics of the slot part 612, for example, in the electromagnetic coupling of the slot part 612 and its associated power supply antenna member 620.

FIGS. 7A-7D illustrate slot parts capable of being installed in a variety of positions in an antenna device according to the exemplary embodiments of the present invention.

Referring to FIGS. 7A-7D, various embodiments of slot antenna members 710, 720, 730, 740 are shown with respective slot parts 712, 722, 732, 742. Each slot part 712, 722, 732, 742 may be formed from a singular or monolithic metal member or formed by a combination of a variety of metal members. Each slot part 712, 722, 732, 742 may be formed and oriented in an upper part, a lower part, or a side end or side part of their respective slot antenna member 710, 720, 730, 740 and mounted in the portable terminal 10 of FIG. 1. In particular, it is desirable that the slot parts 712, 722, 732, 742 are installed in a position and orientation where a hand of a user, which holds the portable terminal 10, does not disturb, block, or otherwise interfere with the radiation from the slot parts 712, 722, 732, 742. Accordingly, a first slot part 712 may be fabricated to be located substantially in an upper portion of a first slot antenna member 710, shown in FIG. 7A, to be installed in a portable terminal which has the hand of the user typically placed in the lower portion of the portable terminal, so that the first slot part 712 in the upper portion will be relatively distant from the hand of the user, to provide improved antenna performance with minimal interference from the hand of the user.

Figure 7A:
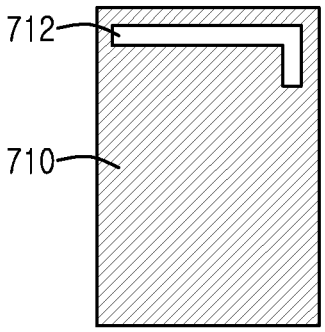
FIGS. 7A-7D illustrate exemplary embodiments of slot parts capable of being installed in a variety of positions in an antenna device according to the exemplary embodiments of the present invention.
Figure 7B:
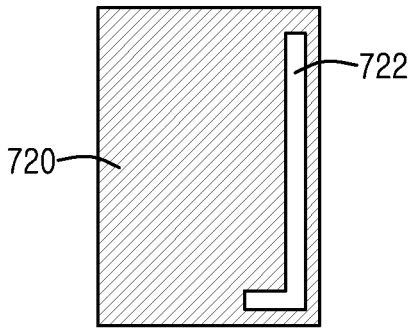

Similarly, a second slot part 722 may be fabricated to be located substantially on a right side portion of a second slot antenna member 720, shown in FIG. 7B, to be installed in a portable terminal which has the hand of the user typically placed on a left side portion of the portable terminal, so that the second slot part 722 on the right side portion will be relatively distant from the hand of the user, to provide improved antenna performance with minimal interference from the hand of the user.

Figure 7C:
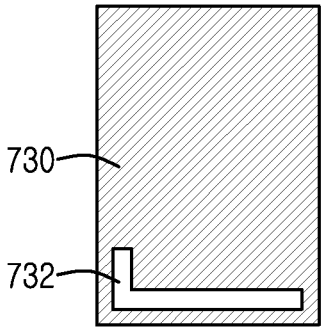

In addition, a third slot part 732 may be fabricated to be located substantially in a lower portion of a third slot antenna member 730, shown in FIG. 7C, to be installed in a portable terminal which has the hand of the user typically placed in the upper portion of the portable terminal, so that the third slot part 732 in the lower portion will be relatively distant from the hand of the user, to provide improved antenna performance with minimal interference from the hand of the user.

Figure 7D:
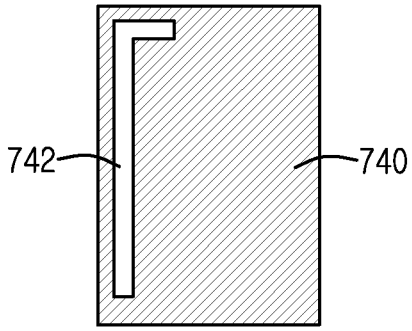

Furthermore, a fourth slot part 742 may be fabricated to be located substantially on a left side portion of a fourth slot antenna member 740, shown in FIG. 7D, to be installed in a portable terminal which has the hand of the user typically placed on a right side portion of the portable terminal, so that the fourth slot part 742 on the left side portion will be relatively distant from the hand of the user, to provide improved antenna performance with minimal interference from the hand of the user.

The slots 712, 722, 732, 742 may be relatively empty; that is, formed during manufacture to be filled with air or other typical gases inserted during the manufacturing process. For example, the slots 722, 732, 742 in FIGS. 7B-7D, respectively, are empty slots, similar to the various empty or unfilled slots shown in other figures and described herein. Alternatively, the slots may be filled with a substance, such as a dielectric or a magnetic substance, as described in connection with FIG. 4 herein. For example, the slot 712 shown in FIG. 7A may be filled in with a dielectric or a magnetic substance for improved antenna performance.

Figure 8A:
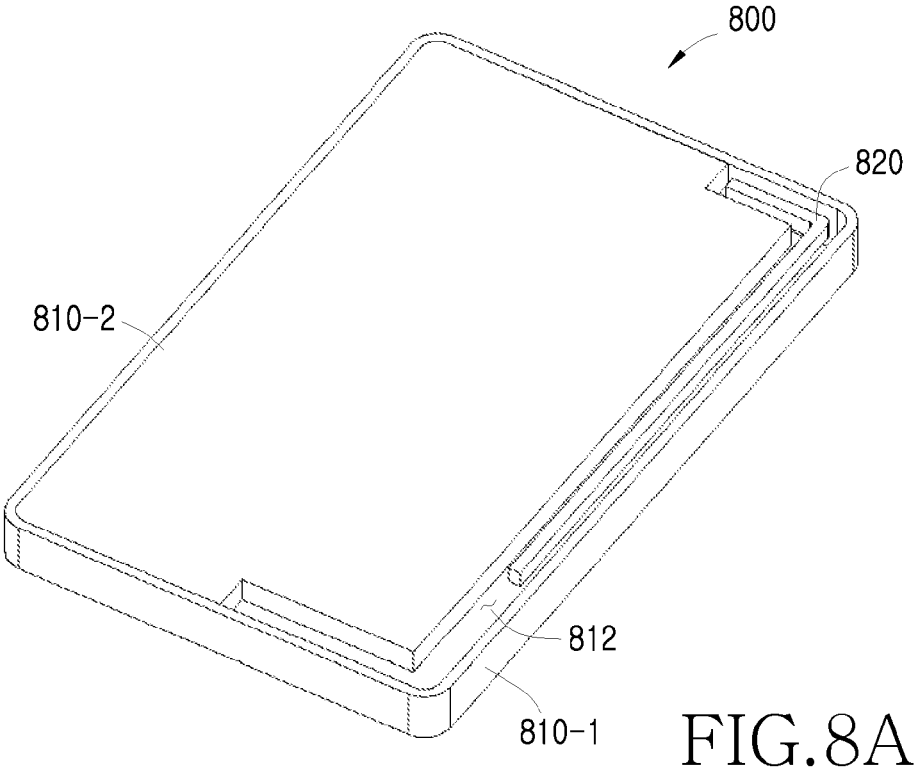
FIG. 8A illustrates a perspective view of a structure of an antenna device according to another exemplary embodiment of the present invention, which is formed in a portable terminal.
Figure 8B:
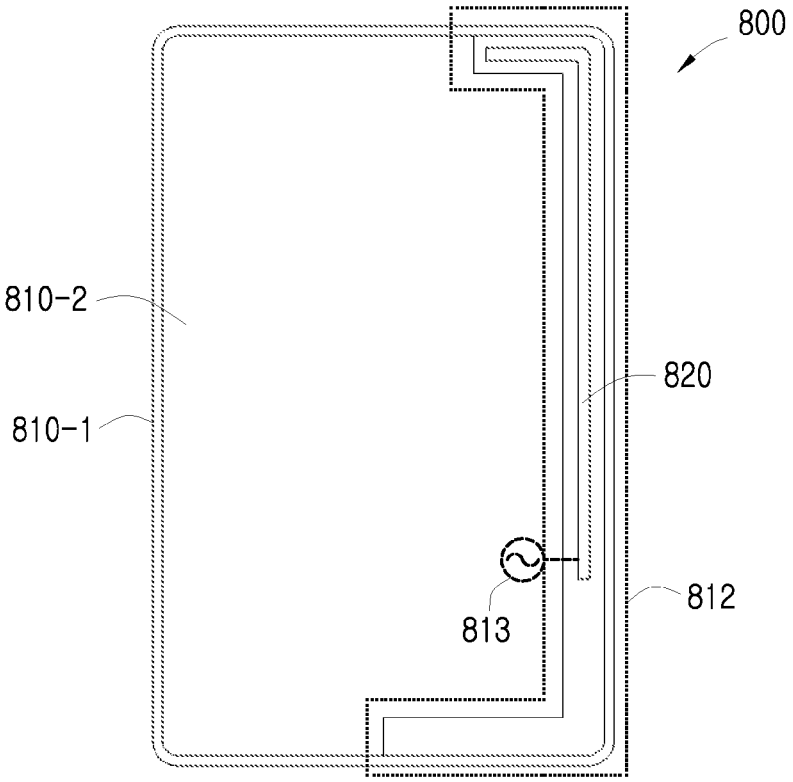
FIG. 8B illustrates a plan view of the structure of FIG. 8A.

FIGS. 8A-8B illustrate a structure of an antenna device according to another embodiment of the present invention, which is installed in a portable terminal.

Referring to FIGS. 8A-8B, the antenna device denoted by 800, according to another embodiment of the present invention, includes a metallic case frame 810-1 for forming the external appearance of the portable terminal, a metal member 810-2 equipped with a slot part 812 in combination with the case frame 810-1, a power supply antenna member 820 which is positioned in the slot part 812, and a power supply part 813 for supplying power to the power supply antenna member 820. The power supply antenna member 820 receives power from the power supply part 813 and radiates radio waves. The slot part 812 is electromagnetically coupled with the power supply antenna member 820 and radiates radio waves. As shown in FIGS. 8A-8B, the slot part 812 may have a thin and long groove shape. The power supply antenna member 820 may have a shape such that the power supply antenna member 820 is positioned along a groove of the slot part 812.

The metal member 810-2 may be a metal plate for mounting thereon a main board, a display unit, etc. of the portable terminal, a metal structure for supporting a battery, etc. The main board is part of an overall operation of the portable terminal and is equipped with the power supply part 813.

Figure 9A:
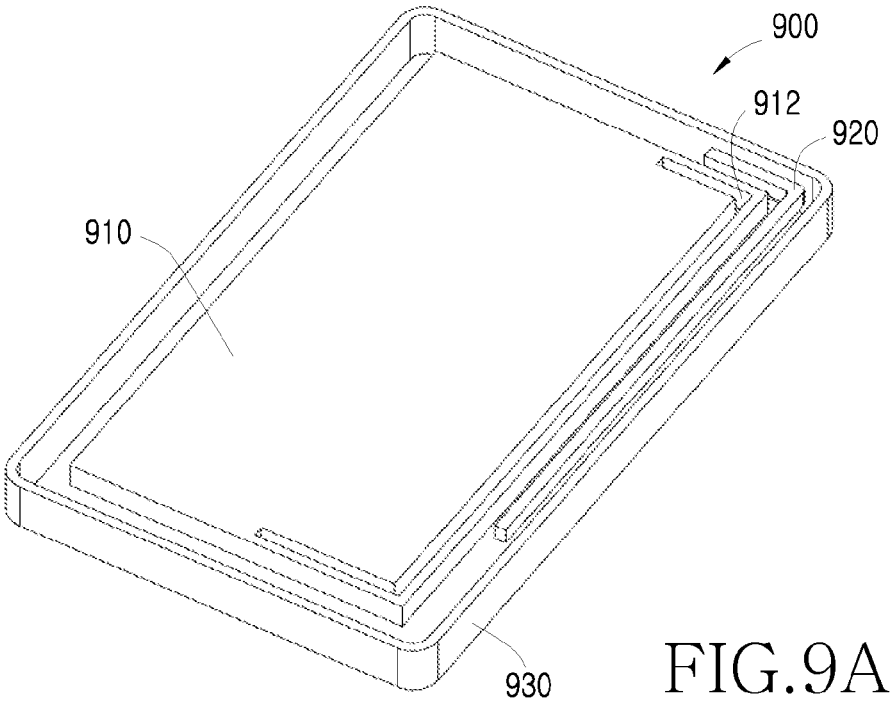
FIG. 9A illustrates a perspective view of a structure of an antenna device according to a further exemplary embodiment of the present invention, which is formed in a portable terminal.
Figure 9B:
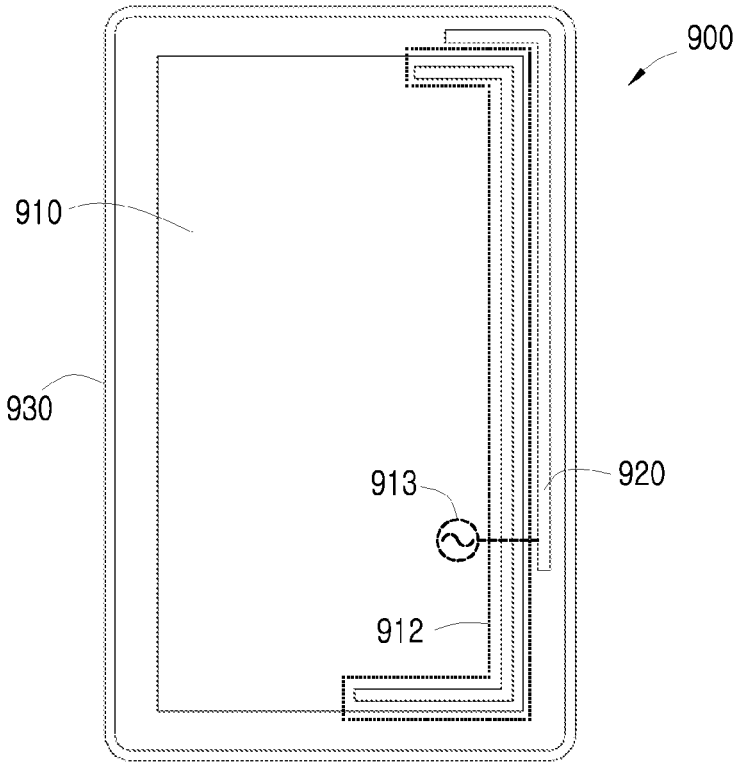
FIG. 9B illustrates a plan view of the structure of FIG. 9A.

FIGS. 9A-9B illustrate a structure of an antenna device according to a further exemplary embodiment of the present invention, which is installed in a portable terminal.

Referring to FIGS. 9A-9B, the antenna device denoted by 900, according to the further exemplary embodiment of the present invention, includes a slot antenna member 910 equipped with a slot part 912, a power supply antenna member 920 which is positioned out of the slot part 912, and a power supply part 913 for supplying power to the power supply antenna member 920. The power supply antenna member 920 receives power from the power supply part 913 and radiates radio waves. The slot part 912 of the slot antenna member 910 is electromagnetically coupled with the power supply antenna member 920 and radiates radio waves.

In particular, the antenna device 900 further includes a metallic case frame 930 which surrounds the slot antenna member 910 and the power supply antenna member 920 and forms the appearance of the portable terminal. The case frame 930 protects the slot antenna member 910 and the power supply antenna member 920 from the outside and prevents performance of the antenna device 900 from being degraded by an external factor (e.g., a hand of a user). The case frame 930 is insulated with the slot antenna member 910 and the power supply antenna member 920. The power supply antenna member 920 is interposed between the slot antenna member 910 and the case frame 930 and has a shape such that the power supply antenna member 920 is positioned along a groove of the slot part 912.

The slot antenna member 910 may be a metal plate for mounting thereon a main board, a display unit, etc. of the portable terminal. The main board is part of the overall operation of the portable terminal and is equipped with the power supply part 913.

Figure 10A:
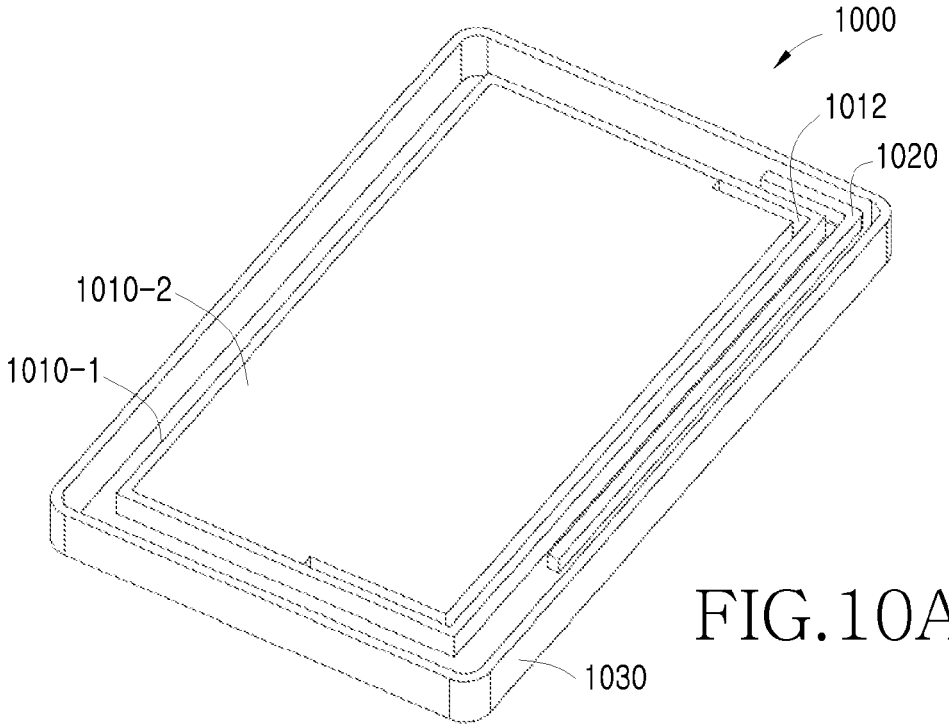
FIG. 10A illustrates a perspective view of a structure of an antenna device according to still another exemplary embodiment of the present invention, which is formed in a portable terminal.
Figure 10B:
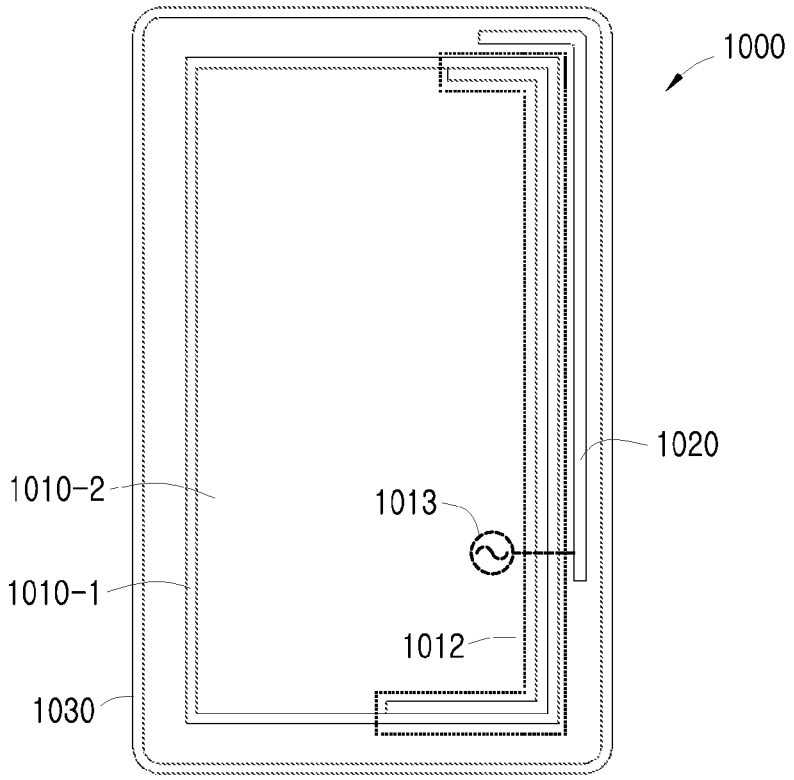
FIG. 10B illustrates a plan view of the structure of FIG. 10B.

FIGS. 10A-10B illustrate a structure of an antenna device according to still another exemplary embodiment of the present invention, which is installed in a portable terminal.

Referring to FIGS. 10A-10B, the antenna device denoted by 1000, according to the instant exemplary embodiment of the present invention, includes a first metal member 1010-1, a second metal member 1010-2 equipped with a slot part 1012 in combination with the first metal member 1010-1, a power supply antenna member 1020 which is positioned out of the slot part 1012, and a power supply part 1013 for supplying power to the power supply antenna member 1020. The power supply antenna member 1020 receives power from the power supply part 1012 and radiates radio waves. The slot part 1012 is electromagnetically coupled with the power supply antenna member 1020 and radiates radio waves. As shown in FIGS. 10A-10B, the slot part 1012 may have a thin and long groove shape. The power supply antenna member 1020 may have a shape such that the power supply antenna member 1020 is positioned along a groove of the slot part 1012.

The second metal member 1010-2 may be a metal plate for mounting thereon a main board, a display unit, etc. of the portable terminal. The first metal member 1010-1 has a shape such that the first metal member 1010-1 substantially surrounds the second metal member 1010-2 and may support the second metal member 1010-2. The main board is part of an overall operation of the portable terminal and is equipped with the power supply part 1013.

The antenna device 1000 may further include a metallic case frame 1030 which surrounds the first metal member

1010-1 and the power supply antenna member 1020 and forms the appearance of the portable terminal. The case frame 1030 is insulated with the first metal member 1010-1 and the power supply antenna member 1020. The case frame 1030 protects the first metal member 1010-1, the second metal member 1010-2, and the power supply antenna member 1020 from the outside and protects performance of the antenna device 1000 from being degraded by an external factor (e.g., a hand of a user). The power supply antenna member 1020 is interposed between the first metal member 1010-1 and the case frame 1030 and has a shape such that the power supply antenna member 1020 is positioned along a groove of the slot part 1012.

Figure 11:
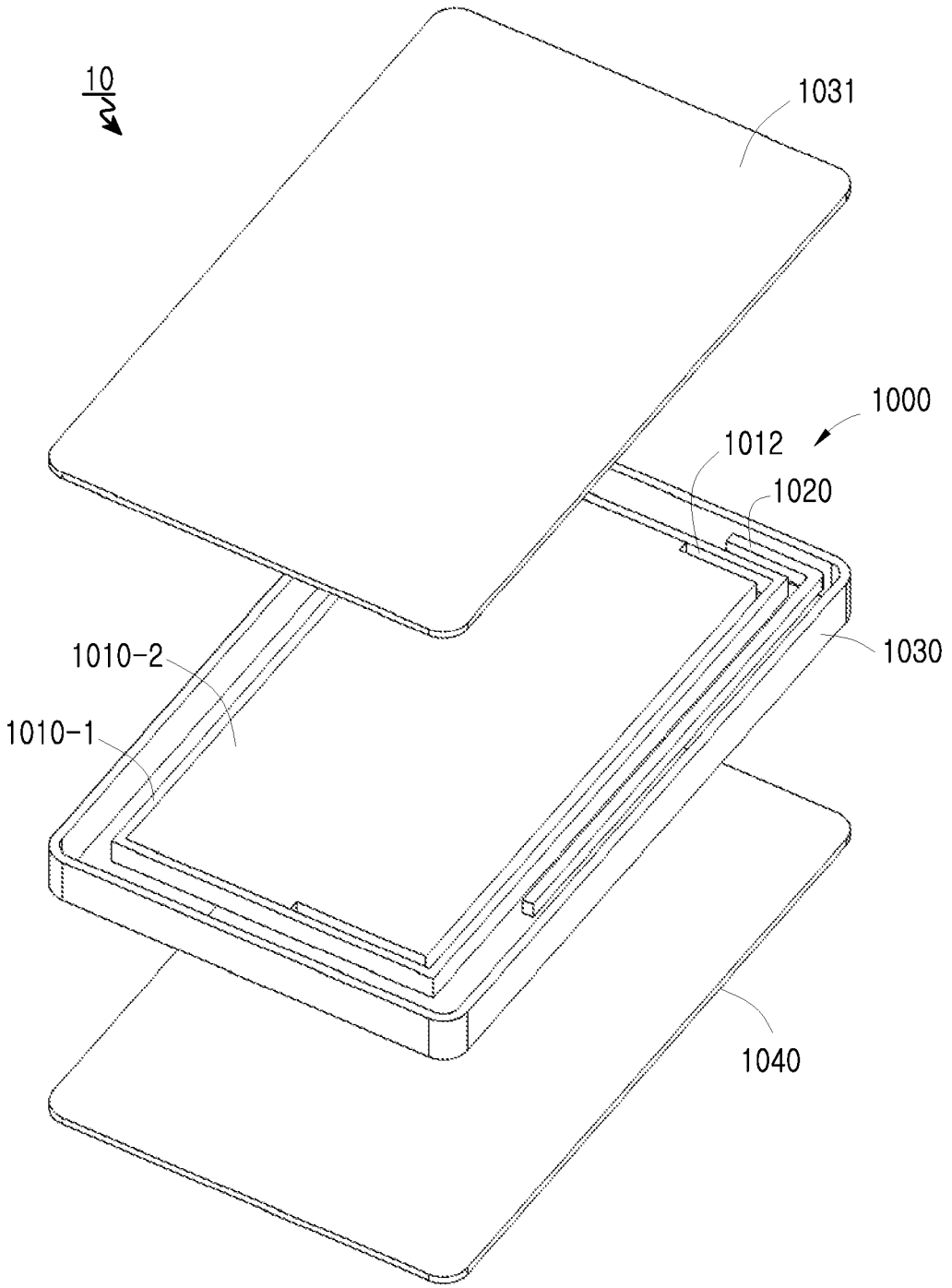
FIG. 11 illustrates a perspective view with parts separated of a structure of a portable terminal including the antenna device of the exemplary embodiment shown in FIGS. 10A-10B.

FIG. 11 illustrates a structure of a portable terminal including the antenna device of FIGS. 10A-10B.

Referring to FIG. 11, the portable terminal denoted by 10 includes a metallic or non-metallic cover 1031 for covering an upper part of an antenna device 1000, and a display unit 1040 for covering a lower part of the antenna device 1000. As described above, a metal plate 1010-2 for mounting the display unit 1040 may be included in the antenna device 1000. This metal plate 1010-2 may optionally be a metal member used in forming the slot part 1012.

Figure 12B:
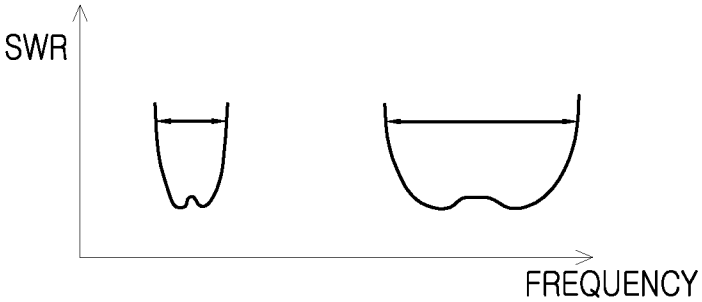
FIGS. 12A-12B are waveform charts illustrating radiation characteristics of an antenna device according to the exemplary embodiments of the present invention.
Figure 12A:
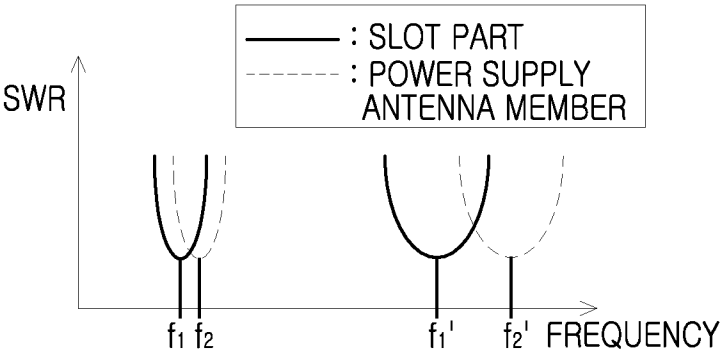

FIGS. 12A-12B illustrate radiation characteristics of an antenna device according to the exemplary embodiments of the present invention.

Referring to FIG. 12A, a slot part which is electromagnetically coupled with a power supply antenna member resonates at a low frequency $f_1$ and at a high frequency $f_1'$ which is a multiple of the low frequency $f_1$. Also, the power supply antenna member installed in or out of the slot part according to the various exemplary embodiments of the present invention resonates at a low frequency $f_2$ and a high frequency $f_2'$ which is a multiple of the low frequency $f_2$. Referring to FIG. 12B, the slot part and the power supply antenna member are matched and may implement resonance characteristics of a multi-band and/or a wideband antenna.

Figure 13A:
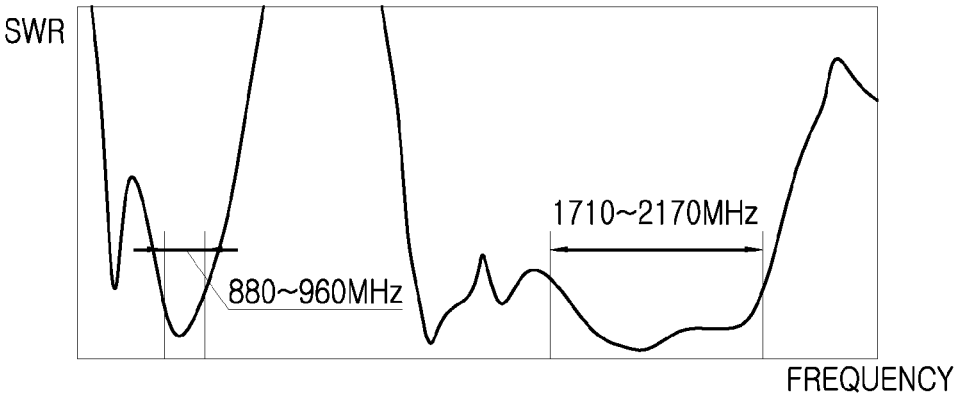
FIGS. 13A-13B are waveform charts illustrating a resonance characteristic of the antenna device according to the exemplary embodiment shown in FIGS. 10A-10B.
Figure 13B:
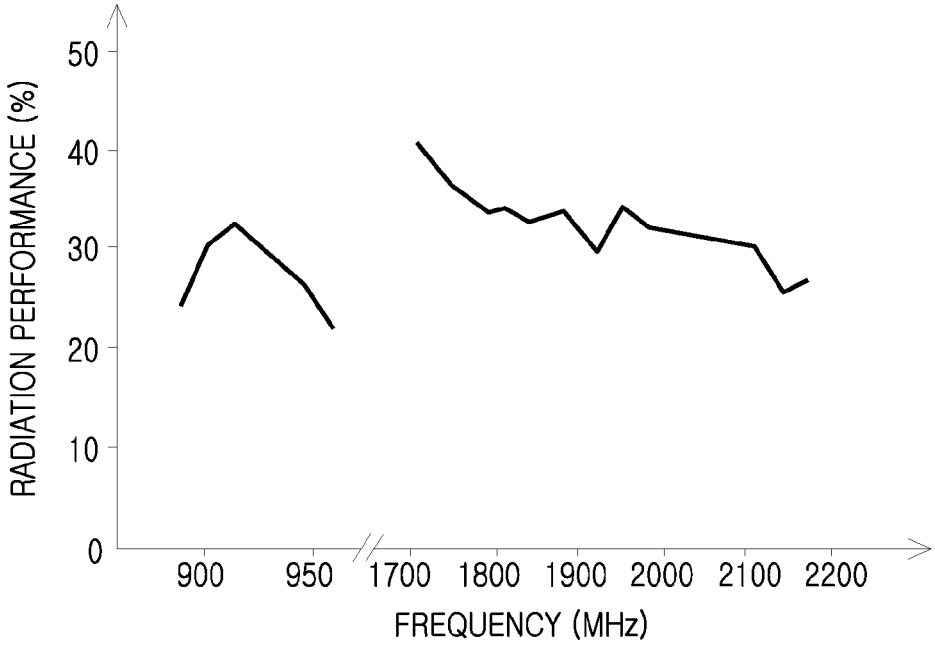

FIGS. 13A-13B illustrate resonance characteristics of an antenna device according to the exemplary embodiment shown in FIGS. 10A-10B and described herein.

Referring to FIG. 13A, the antenna device 1000 according to the exemplary embodiment of the present invention shown in FIGS. 10A-10B may implement resonance characteristics of a multi-band and/or a wideband antenna. That is, the antenna device 1000 may be applied to a portable terminal for operating as a triple-band or a quad-band antenna. For example, the antenna device 1000 according to one exemplary embodiment of the present invention may transmit and receive radio waves in a band which encompasses the frequencies of, for example, 900 MHz, 1800 MHz, 1900 MHz, and 2100 MHz. In addition, referring to FIG. 13B, it is known that antenna performance at this band may be attained with an improved performance, such as quality of signal reception, of 30% or more.

In conclusion, the present invention may use a metal member, which is typically considered a factor in degraded antenna performance, as instead a counterpart capable of securing improved antenna performance in a portable terminal.

The above-described portable terminal and associated components thereof and methods of use according to the present invention can be implemented in hardware, firmware or as software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the present invention has been particularly shown and described with reference to exemplary embodiments thereof, it will be understood by those skilled in the art that various changes in form and details may be made therein without departing from the spirit and scope of the present invention as defined by the appended claims

What is claimed is:

1. An antenna device for a portable terminal, comprising:

a main board equipped with a power supply part for supplying power;

a slot part which is formed in at least one metal member of a metallic case frame defining an external appearance of the portable terminal; and a power supply antenna member for receiving power from the power supply part and being electromagnetically coupled with the slot part.

2. The antenna device of claim 1, wherein the slot part is formed in a metal structure for mounting a component of the portable terminal which is connected with the main board.

3. The antenna device of claim 1, wherein the slot part is formed to have substantially an L-shape.

4. The antenna device of claim 1, wherein the slot part is filled with a dielectric.

5. The antenna device of claim 1, wherein the slot part is filled with a magnetic substance.

6. The antenna device of claim 1, wherein the slot part is installed in a predetermined position in the portable terminal selected from the group consisting of an upper part, a lower part, and a side part of the portable terminal.

7. The antenna device of claim 1, wherein the power supply antenna member is positioned in the slot part.

8. The antenna device of claim 1, wherein the power supply antenna member has a shape extending substantially parallel along a groove of the slot part.

9. The antenna device of claim 1, wherein the power supply antenna member is electrically connected with the power supply part at a first end and is electrically connected with a ground surface at a second end.

10. The antenna device of claim 1, wherein the power supply antenna member is interposed between two metal members.

11. The antenna device of claim 1, wherein the power supply antenna member is operated as a monopole-type antenna.

12. The antenna device of claim 1, wherein the power supply antenna member is matched with the slot part.

13. The antenna device of claim 1, wherein the antenna device operates using at least one resonance frequency.

14. The antenna device of claim 1, wherein the antenna device resonates at a frequency in a frequency band of 900 MHz to 2100 MHz.

15. The antenna device of claim 1, wherein the power supply antenna member is positioned externally relative to the slot part.

16. The antenna device of claim 1, wherein the power supply antenna member is operated as a loop-type antenna.

17. The antenna device of claim 1, wherein the slot part is formed in a ground surface of the main board.

18. An antenna device for a portable terminal having a power supply, the antenna device comprising:

a member composed at least of a metal and having a slot formed in a ground surface of a main board therein; and a power supply antenna member for receiving power from the power supply and being electromagnetically coupled with the slot, wherein the power supply antenna member is positioned in the slot.

19. A method for implementing an antenna device for a portable terminal having a power supply, the method comprising:

forming a member composed of at least two metal members defining a slot therein; and receiving power at a power supply antenna member from the power supply, the power supply antenna member interposed between the at least two metal members; and electromagnetically coupling the power supply antenna member with the slot for implementing the antenna device.

* * * * *